US008794440B2

(12) United States Patent
BeVier et al.

(10) Patent No.: US 8,794,440 B2
(45) Date of Patent: Aug. 5, 2014

(54) TRAY WITH RIBS CONFIGURED FOR REDIRECTING COMPRESSIVE LOADS

(75) Inventors: Corey Jacob BeVier, Sun Prairie, WI (US); Bonita M. Hinze, Sun Prairie, WI (US); MeeWha Lee, Waunakee, WI (US)

(73) Assignee: Kraft Foods Group Brands LLC, Northfield, IL (US)

( * ) Notice: Subject to any disclaimer, the term of this patent is extended or adjusted under 35 U.S.C. 154(b) by 238 days.

(21) Appl. No.: 13/180,348

(22) Filed: Jul. 11, 2011

(65) Prior Publication Data

US 2013/0015096 A1 Jan. 17, 2013

(51) Int. Cl.

| | |
|---|---|
| ***B65D 21/00*** | (2006.01) |
| ***B65D 85/62*** | (2006.01) |
| ***B65D 1/34*** | (2006.01) |
| ***B65D 1/42*** | (2006.01) |

(52) U.S. Cl.

CPC ... *B65D 1/34* (2013.01); *B65D 1/42* (2013.01)
USPC ..... 206/507; 206/557

(58) Field of Classification Search

USPC ..... 206/503–507, 557, 563, 594, 564; 220/62.13, 62.11, 574, 574.3
See application file for complete search history.

(56) References Cited

U.S. PATENT DOCUMENTS

| | | | | | |
|---|---|---|---|---|---|
| 2,859,557 | A | | 11/1958 | Lattuca | |
| 2,905,350 | A | | 9/1959 | Edwards | |
| D212,594 | S | * | 11/1968 | Collie | D9/425 |
| D213,428 | S | | 3/1969 | Batdorf | |
| 3,519,165 | A | | 7/1970 | Hawley | |
| 4,052,037 | A | | 10/1977 | Mair et al. | |
| D253,331 | S | | 11/1979 | Olschewski | |
| D282,824 | S | | 3/1986 | Franek et al. | |
| 5,224,623 | A | | 7/1993 | LaFleur | |
| D353,518 | S | * | 12/1994 | Cautereels et al. | D7/560 |
| 5,381,901 | A | | 1/1995 | Hundley | |
| D366,211 | S | * | 1/1996 | Buff et al. | D9/425 |
| D391,762 | S | | 3/1998 | Ahern, Jr. | |
| D414,080 | S | | 9/1999 | Bolwien | |
| D469,319 | S | | 1/2003 | Pettaweebuncha | |
| D469,665 | S | | 2/2003 | Pettaweebuncha | |
| 6,554,154 | B1 | | 4/2003 | Chauhan et al. | |
| D475,620 | S | | 6/2003 | Chen et al. | |
| D485,174 | S | | 1/2004 | Amar et al. | |
| 6,910,599 | B2 | | 6/2005 | Tucker et al. | |
| D508,187 | S | * | 8/2005 | Dais et al. | D7/602 |
| D514,389 | S | | 2/2006 | Luna et al. | |
| D536,608 | S | | 2/2007 | Arkins | |
| D539,099 | S | | 3/2007 | Tucker et al. | |

(Continued)

*Primary Examiner* — Luan K Bui
*Assistant Examiner* — Rafael Ortiz
(74) *Attorney, Agent, or Firm* — Fitch, Even, Tabin & Flannery LLP

(57) ABSTRACT

A tray, as described herein, includes one or more ribs that increase the stacking or compressive strength of the tray and advantageously direct vertical compressive stacking forces to the relatively stronger portions of the tray. Specifically, the ribs direct the compressive stacking forces from the intermediate portions of the sidewall downward and outward toward the adjacent corners. The ribs can have an at least partially curvilinear shape between the intermediate portion of the sidewall and the adjacent corner thereof, such as having an intermediate generally bell-shaped region such that a vertex of the concave region is higher on the sidewall than where its legs intersect the corners of the tray. In another or alternative form, the tray can include one or more gripping portions that facilitate a user holding onto the tray.

20 Claims, 8 Drawing Sheets

(56) References Cited

U.S. PATENT DOCUMENTS

| | | | | |
|---|---|---|---|---|
| D539,134 | S | 3/2007 | Wallach | |
| 7,261,219 | B2 | 8/2007 | Tucker et al. | |
| D569,722 | S | 5/2008 | Stamper et al. | |
| D584,108 | S | 1/2009 | Olsson | |
| 7,546,932 | B2 * | 6/2009 | Smith et al. | 220/675 |
| D606,811 | S * | 12/2009 | Furlong | D7/602 |
| D608,153 | S | 1/2010 | Furlong | |
| D608,154 | S | 1/2010 | Furlong | |
| D613,125 | S | 4/2010 | Sierra et al. | |
| D613,556 | S | 4/2010 | Sierra et al. | |
| D615,356 | S | 5/2010 | Hillebrenner | |
| D616,251 | S | 5/2010 | Heiberg et al. | |
| D617,144 | S | 6/2010 | O'Connor et al. | |
| D629,658 | S | 12/2010 | Rusnak et al. | |
| D632,527 | S | 2/2011 | Olivari et al. | |
| D632,528 | S * | 2/2011 | Olivari et al. | D7/587 |
| D636,230 | S | 4/2011 | Koennecke | |
| D637,041 | S | 5/2011 | Haskell | |
| D641,211 | S | 7/2011 | Olivari et al. | |
| D641,212 | S | 7/2011 | Olivari et al. | |
| D641,590 | S | 7/2011 | Koennecke | |
| D646,968 | S | 10/2011 | Ortiz et al. | |
| D649,396 | S | 11/2011 | Wilkens et al. | |
| D656,010 | S | 3/2012 | Ortiz et al. | |
| D656,815 | S | 4/2012 | Fisher et al. | |
| D678,050 | S | 3/2013 | Birchmeier et al. | |
| D684,855 | S | 6/2013 | BeVier et al. | |
| D689,363 | S | 9/2013 | Sundy et al. | |
| D696,938 | S | 1/2014 | BeVier et al. | |
| 2007/0119743 | A1 * | 5/2007 | Tucker et al. | 206/503 |
| 2008/0202969 | A1 | 8/2008 | Tauer | |
| 2010/0065461 | A1 * | 3/2010 | Chhay | 206/505 |
| 2010/0096288 | A1 * | 4/2010 | Feldmann et al. | 206/505 |

* cited by examiner

TRAY WITH RIBS CONFIGURED FOR REDIRECTING COMPRESSIVE LOADS

FIELD

This description relates to containers, and specifically to trays having ribbing for strength.

BACKGROUND

Various trays are utilized for storage of contents, such as food products. Commonly, the intended uses of a specific tray can determine the strength that the tray requires. Increasing the sidewall thickness of a tray can increase the stacking strength of the tray, but the increased material required for the extra sidewall thickness can undesirably increase production costs. Ribbing extending vertically from an upper edge of a sidewall to a bottom wall is known to increase the stacking strength of a sidewall. As such, a thin sidewall with ribbing can have a stacking strength similar to a relatively thicker sidewall. For many purposes, a tray having a thin sidewall with vertical ribbing is sufficient.

Compressive strength is the capacity of a material or structure to withstand vertical loads. When the limit of compressive strength is reached, materials are crushed. Increased compressive strength can be important in food product storage because multiple containers can be stacked on top of one another for storage and display purposes. If too much weight is stacked on a container, the container can be crushed or otherwise deformed, and the appearance of the container and its contents negatively impacted. Accordingly, the compressive strength of the individual containers can limit the size of available storage receptacles and display configurations for groups of the containers.

SUMMARY

A tray includes relatively thin thermoformed walls and being configured to receive and store a foodstuff. The tray is strengthened for supporting compressive loads when stacked or otherwise having objects stacked thereon. The tray includes a bottom wall having four corners and a sidewall extends about and upstanding from the bottom wall. The sidewall has an upper periphery, four corners, and a sidewall segment extending between adjacent pairs of the corners. In a first aspect, each of the sidewall segments has at least one continuous, protruding rib configured to redirect vertical compressive forces from a mid-point of the sidewall segment to each of the adjacent corners. Pursuant to this, the rib includes inclined portions proximate to the midpoint and extending at a downward inclination toward the bottom wall and opposing ones of the adjacent corners. In another aspect, each of the sidewall portions includes at least one outwardly protruding rib extending thereacross. The rib has a bell-shaped configuration with an upper vertex thereof positioned generally centrally on the respective sidewall portion and legs extending downwardly from the upper vertex to intersect adjacent sidewall corners at a height of the sidewall lower than the upper vertex.

DETAILED DESCRIPTION

Figure 1:
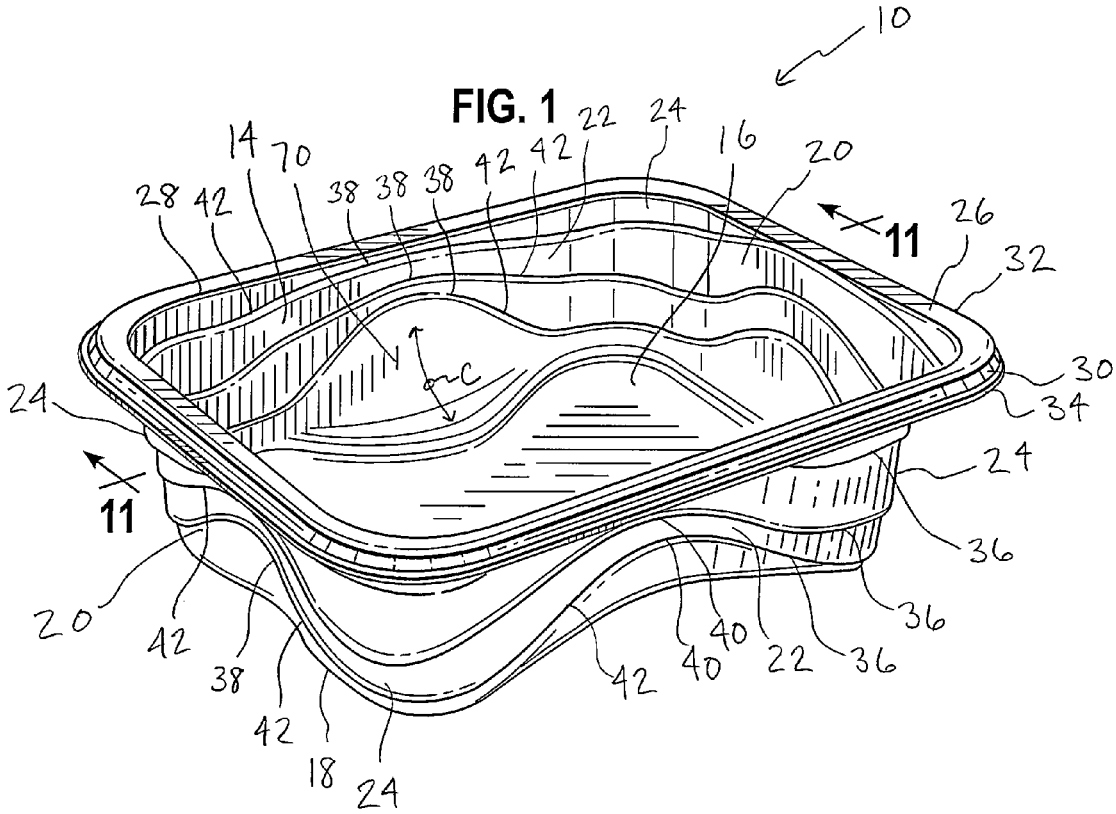
FIG. 1 is a perspective view of a first embodiment of a tray with a bottom wall and an upstanding sidewall having three bell-shaped ribs on sidewall portions thereof and depressions extending from the bottom wall to the sidewall portions.

A tray, as described herein, includes one or more ribs that increase the stacking or compressive strength of the tray and advantageously direct vertical compressive stacking forces to the relatively stronger portions of the tray. Specifically, the tray ribs direct the vertical compressive stacking loads from the intermediate portions of the sidewall downward and outward toward the adjacent corners, which are relatively stronger than adjacent portions of the sidewall or bottom wall. Pursuant to this, the ribs can have an at least partially curvilinear shape, and specifically a bell-shaped curve, between the intermediate portion of the sidewall and the adjacent corner thereof. In a preferred form, each rib includes an intermediate generally concave region such that the vertex of the concave region is higher on the sidewall than where its legs intersect the corners of the tray.

In another or alternative form, the tray can include one or more depressions that span from a bottom wall portion onto respective sidewall portions, such that the corner between the sidewall portions and the bottom wall is broken by the depressions and the sidewall portions do not directly intersect the bottom wall in the area of the depression. With such a configuration, a vertical rib extending on the sidewall would not reach the bottom wall in this area and therefore compressive loads would be transferred to this depression on the sidewall rather than a support surface underneath the tray or the relatively stronger corners of the tray. In one aspect, the one or more depressions can act as gripping portions that facilitate a user holding onto the tray, such as with a cupping hand configuration.

Advantageously, the ribs discussed above can include a generally complementary configuration to the depression extending onto the sidewall of the tray. Specifically, the bell-shaped curve can be at least partially complementary to a curved end of the depression on the tray sidewall. As discussed above, vertical ribs would disadvantageously intersect the depression along the sidewall prior to the bottom wall, which could decrease the stacking strength benefit provided by the vertical ribbing as compared to an otherwise flat sidewall. The curvilinear ribs described herein, however, advantageously increases the stacking strength of the tray while also extending at least partially along the gripping indentation on the tray sidewall.

Turning now to the figures, a tray 10 is illustrated having one or more ribs or steps 12 in a stacked configuration extending along a sidewall 14 of the tray 10 for increasing the strength thereof. The tray 10 includes a bottom wall portion 16 and the sidewall 14 extending upwardly therefrom. The bottom wall portion 16 and the sidewall 14 joining at corners 18. The bottom wall portion 16 is illustrated as generally rectangular in the figures so that the sidewall 14 includes end portions 20 and side portions 22, with depressions 70 giving the end portions 20 and the side portions 22 an inwardly curved intermediate portion so that the bottom wall portion 16 has a waisted appearance. The depressions 70 will be described in more detail below. The bottom wall portion 16, however, can take other shapes such as other regular and irregular polygons, curvilinear shapes, or combinations thereof. As shown, the end and side portions 20, 22 of the sidewall connect together at corners 24 of the sidewall 14. Inherent in such structures, the corners 24 have a relatively larger stacking strength as compared to the end and side portions 20, 22 of the sidewall 14. In the illustrated form, the corners 18, 24 are rounded but can have sharp edges if desired.

The sidewall 14 includes a shoulder or flange 26 extending outwardly along an entire perimeter thereof on an end 28 opposite from the bottom wall portion 16. A skirt 30 then depends generally downwardly from an outer edge 32 of the shoulder 26. Further, a lip 34 can extend outwardly from the skirt 30.

Turning now to details of the ribs 12 as shown in the figures. The form of the tray 10 shown in FIGS. 1-5 includes three ribs 12, while the form of the tray 10 shown in FIGS. 6-10 includes four ribs 12. The ribs 12 can extend only partially across portions of the sidewall 14, such as intermediate of the corners 24, or entirely around the sidewall 14 as shown in the figures so that the ribs 12 are continuous. The ribs 12 are spaced vertically along the sidewall 14 to strengthen the sidewall 14 at several points along its height.

In a preferred form, the tray 10 is thermoformed. Thermoforming the tray involves heating a plastic sheet to a pliable forming temperature, forming the heated plastic sheet into the tray in a mold, and trimming excess portions of the plastic sheet from the tray. With this forming process, the ribs 12 can take the form of generally horizontal steps that extend between an outwardly positioned upper segment of the sidewall 14 and an inwardly positioned lower segment of the sidewall 14, as shown in the figures. With other manufacturing processes, the ribs 12 can be protuberances extending outwardly or inwardly from the sidewall 14 with an upper edge of the protuberance being generally above the lower edge of the protuberance. The ribs 12 strength the compressive strength of the tray, which allows the thickness of the tray sidewall 14 with a desired compressive strength to be thinner than a tray without the ribs. In the illustrated form, the tray is formed from a sheet having a thickness of about 30 mils.

In the illustrated form of FIGS. 2, 4, 7, and 9 each rib 12 is shown spanning across the respective sidewall portion 20, 22, and extending over the corners 24 therebetween to completely encircle the tray sidewall 14. Each rib portion 36 includes an intermediate curvilinear portion 38 having a generally bell-shape curve that opens downwardly. Preferably, the curvilinear portion 38 is positioned generally centrally horizontally along each side and end sidewall portion 20, 22. The curvilinear portion 38 includes an upper vertex 40 and curvilinear legs 42 extending downwardly therefrom so that the legs 42 intersect the adjacent sidewall corner 24 at a height lower on the sidewall 14 than the vertex 40. As shown, each leg 42 includes a first portion 44 that travels downwardly from the vertex 40 relatively steeply and a second portion 46 that slowly shallows out to horizontal. In the illustrated form, the leg first portion 44 extends generally along an imaginary line extending between the bottom of the adjacent corner 24 and the rib vertex 40. So configured, each rib 12 is configured to direct compressive forces from the center of each sidewall portion 20, 22 generally toward the corners 24 therebetween that have a relatively stronger compressive strength. Alternatively, the ribs 12 can include linear portions with downwardly inclined portions thereof configured to direct the compressive forces, as discussed above.

A specific example of a three rib tray will be described with respect to FIGS. 1-5. As shown, the tray 10 includes three ribs 12 extending therearound including an upper rib 48, and intermediate rib 50, and a bottom rib 52. Each of the ribs 48, 50, 52 have side portions 54 on the side walls 20 and end portions 56 on the end walls 22. Preferably, the side portions 54 are generally identical and the end portions 56 are generally identical, such that the tray looks generally identical when viewed from either side 20 or when viewed from either end 22. If desired, however, the ribs 12 could have different configurations on each sidewall portion 20, 22. Additionally, with other configurations for the bottom wall portion 16, the ribs can be identical on four sides with a square configuration or on three sides with a triangular configuration.

Figure 2:
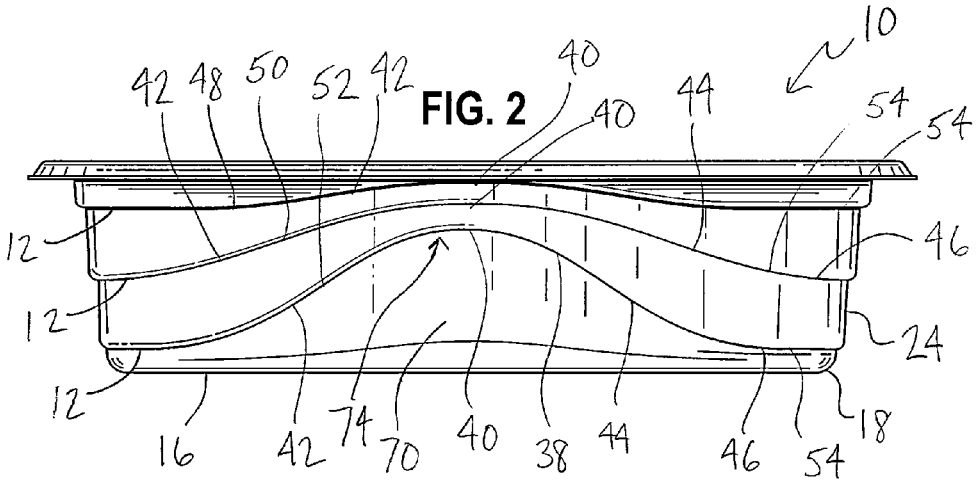
FIG. 2 is a front elevation view of the tray of FIG. 1 showing the three bell-shaped ribs and the depression on a side portion of the sidewall, the rear elevation view being identical.
Figure 3:
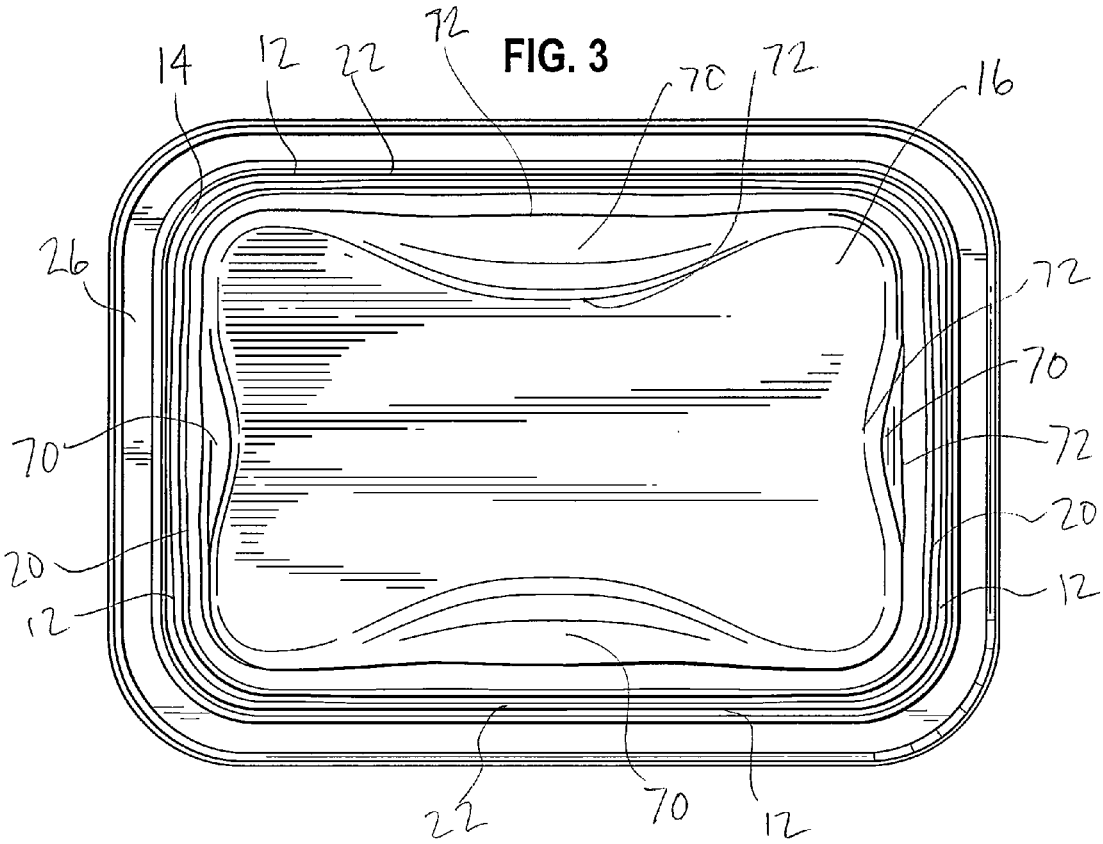
FIG. 3 is a top plan view of the tray of FIG. 1 showing the stepped configuration of the bell-shaped ribs of the sidewall and the depressions extending from the bottom wall to the sidewall portions.

Referring now to the details of the rib side portions 54 shown in FIGS. 1-2 on the sidewall side portion 22. The vertex 40 of the upper rib 48 is slightly spaced from the upper end 28 of the sidewall 14 followed by the vertices 40 of the intermediate rib 50 and the lower rib 52, which are spaced from the upper rib vertex and the intermediate rib vertex, respectively. As shown, the vertices 40 of the intermediate rib 50 and the lower rib 52 can be spaced from adjacent vertices by approximately equal distances, such as about 0.16 inches. In the illustrated form, the vertices 40 of the rib side portions 54 are all positioned on the top half of the sidewall side portion 22. The legs 42 of the rib side portions 54 extend downwardly from their respective vertex 40 so that they intersect the corners 24 of the sidewall side portion 22 at a height lower on the sidewall than the vertex 40. While the vertices 40 of the rib side portions 54 are all positioned in the upper half of the sidewall side portion 22, the legs 42 thereof are spanned across a majority of the height of the sidewall 14. As shown, the vertex 40 of the intermediate rib 50 is positioned at a height of the sidewall side portion 22 approximately equal to or above the height that the legs 42 of the upper rib 48 intersect the sidewall corners 24. Moreover, the vertex 40 of the lower rib 52 is positioned at a height of the sidewall side portion 22 approximately equal to or above the height that the legs 42 of the intermediate rib 50 intersect the sidewall corners 24. In the illustrated form, the upper rib 48 has a relatively shallow profile with the legs 42 thereof intersecting the sidewall corners 24 about 0.16 inches below the vertex 40 thereof; the intermediate rib 50 has a relatively deeper profile with the legs 42 thereof intersecting the sidewall corners 24 about 0.56 inches below the vertex 40 thereof; and the lower rib 52 has the relatively deepest profile with the legs 42 thereof intersecting the sidewall corners about 0.94 inches below the vertex 40 thereof, or spaced 0.19 inches from the bottom wall portion 16.

Figure 4:
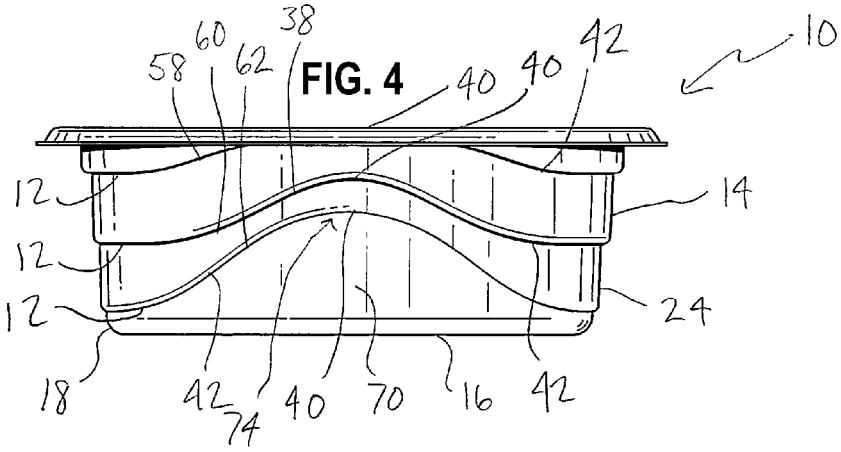
FIG. 4 is a right side elevation view of the tray of FIG. 1 showing the three bell-shaped ribs and the depression on an end portion of the sidewall, the left side elevation view being identical.
Figure 5:
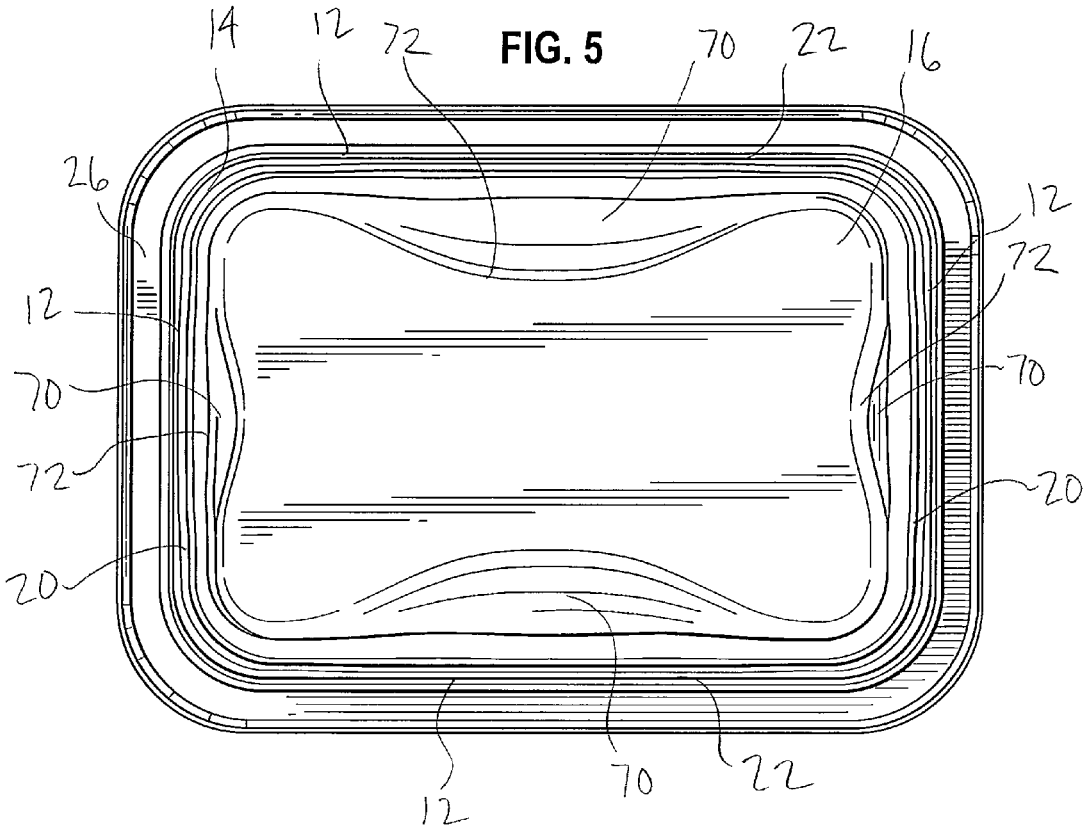
FIG. 5 is a bottom plan view of the tray of FIG. 1 showing the stepped configuration of the bell-shaped ribs of the sidewall and the depressions extending from the bottom wall to the sidewall portions.

Referring now to the details of the rib end portions 56 shown in FIGS. 1 and 4 on the sidewall end portion 20. The vertex 40 of the upper rib 48 abuts or intersects the upper end 28 of the sidewall 14 followed by the vertices 40 of the intermediate rib 50 and the lower rib 52, which are spaced from the upper rib vertex and the intermediate rib vertex, respectively. As shown, the vertex 40 of the intermediate rib 50 is spaced a larger distance from the upper rib 48 than the vertex 40 of the lower rib 52. Specifically, the vertices 40 of upper rib 48 and the intermediate rib 50 are spaced about 0.38 inches, while the vertices 40 of the intermediate rib 50 and the lower rib 52 are spaced about 0.25 inches. Similarly to the rib side portions 54, the vertices 40 of the rib end portions 56 are all positioned on the top half of the sidewall end portion 20. Moreover, the legs 42 of the rib end portions 56 extend downwardly from their respective vertex 40 so that they intersect the corners 24 of the sidewall end portions 22 at a height lower on the sidewall than the vertex 40 thereof. While the vertices 40 of the rib end portions 56 are all positioned in the upper half of the sidewall end portion 20, the legs 42 thereof are spanned across a majority of the height of the sidewall 14 adjacent to the sidewall corners 24. In the illustrated form, the upper rib 48 has a relatively shallow profile with the legs 42 thereof intersecting the sidewall corners 24 about 0.25 inches below the vertex 40 thereof; the intermediate rib 50 has a relatively deeper profile with the legs 42 thereof intersecting the sidewall corners 24 about 0.56 inches below the vertex 40 thereof; and the lower rib 52 has the relatively deepest profile with the legs 42 thereof intersecting the sidewall corners about 0.94 inches below the vertex 40 thereof, or spaced 0.19 inches from the bottom wall portion 16.

A specific example of a four rib tray will be described with respect to FIGS. 6-10. As shown, the tray 10 includes four ribs 12 extending therearound including an upper rib 58, two intermediate ribs 60, and a bottom rib 62. Each of the ribs 58, 60, 62 have side portions 64 on the side walls 20 and end portions 66 on the end walls 22. Similar to the three rib tray discussed above, preferably the side portions 64 are generally identical and the end portions 66 are generally identical, such that the tray looks generally identical when viewed from either side 20 or when viewed from either end 22. If desired, however, the ribs 12 could have different configurations on each sidewall portion 20, 22. Additionally, with other configurations for the bottom wall portion 16, the ribs can be identical on four sides with a square configuration or on three sides with a triangular configuration.

Figure 7:
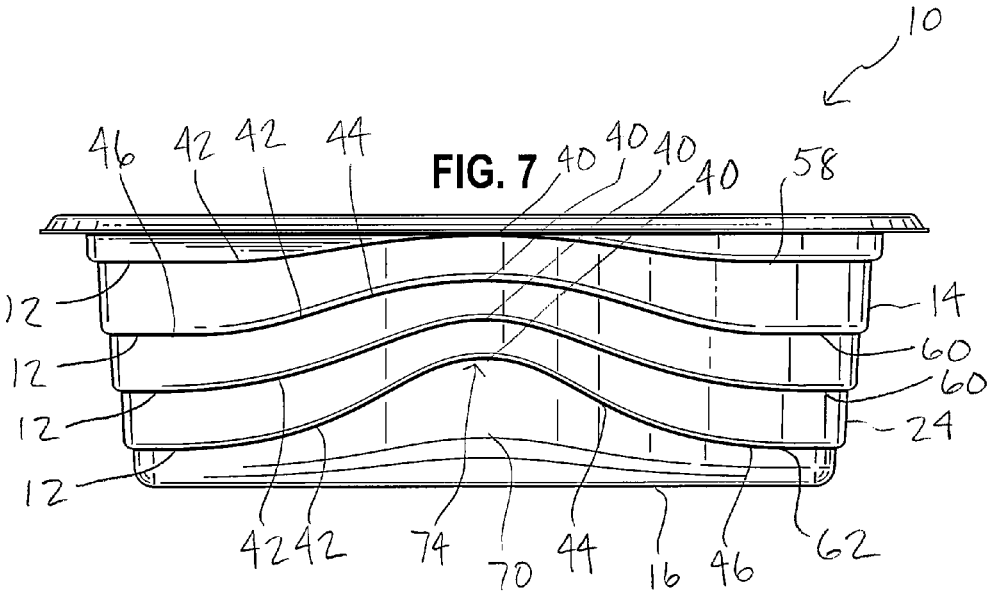
FIG. 7 is a front elevation view of the tray of FIG. 6 showing the three bell-shaped ribs and the depression on a side portion of the sidewall, the rear elevation view being identical.
Figure 8:
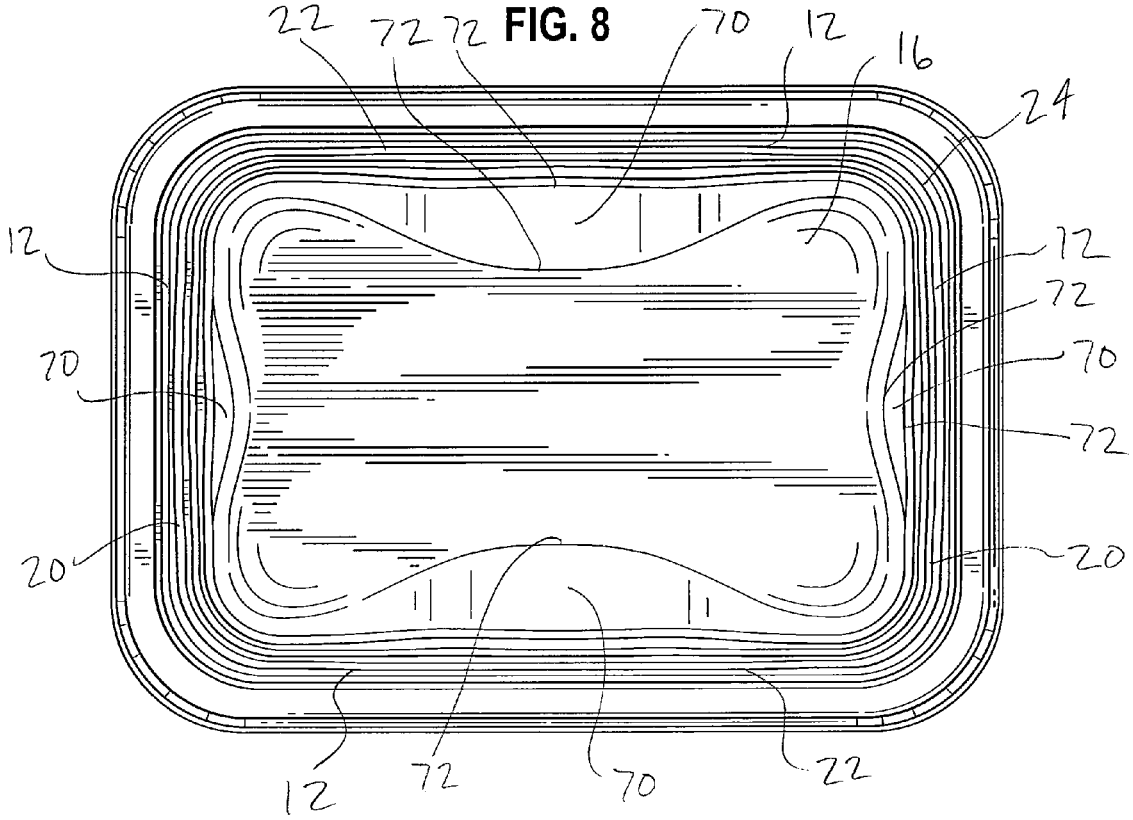
FIG. 8 is a top plan view of the tray of FIG. 6 showing the stepped configuration of the bell-shaped ribs of the sidewall and the depressions extending from the bottom wall to the sidewall portions.
Figure 9:
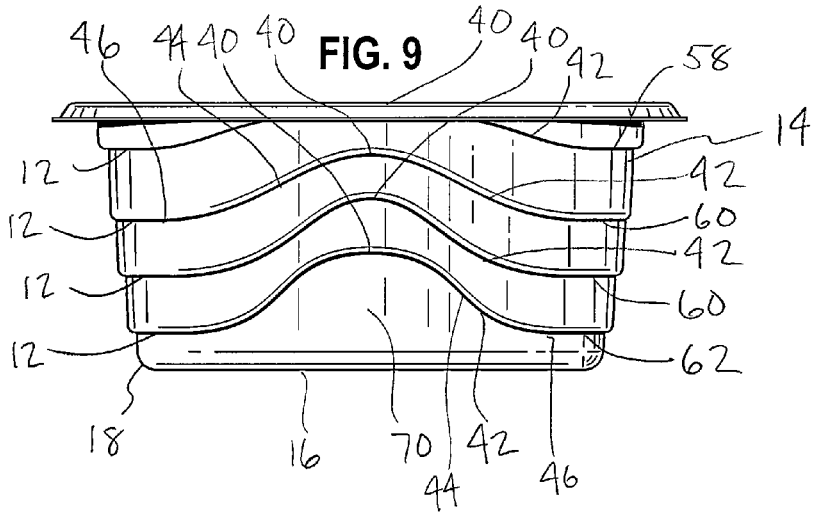
FIG. 9 is right side elevation view of the tray of FIG. 6 showing the three bell-shaped ribs and the depression on an end portion of the sidewall, the left side elevation view being identical.
Figure 10:
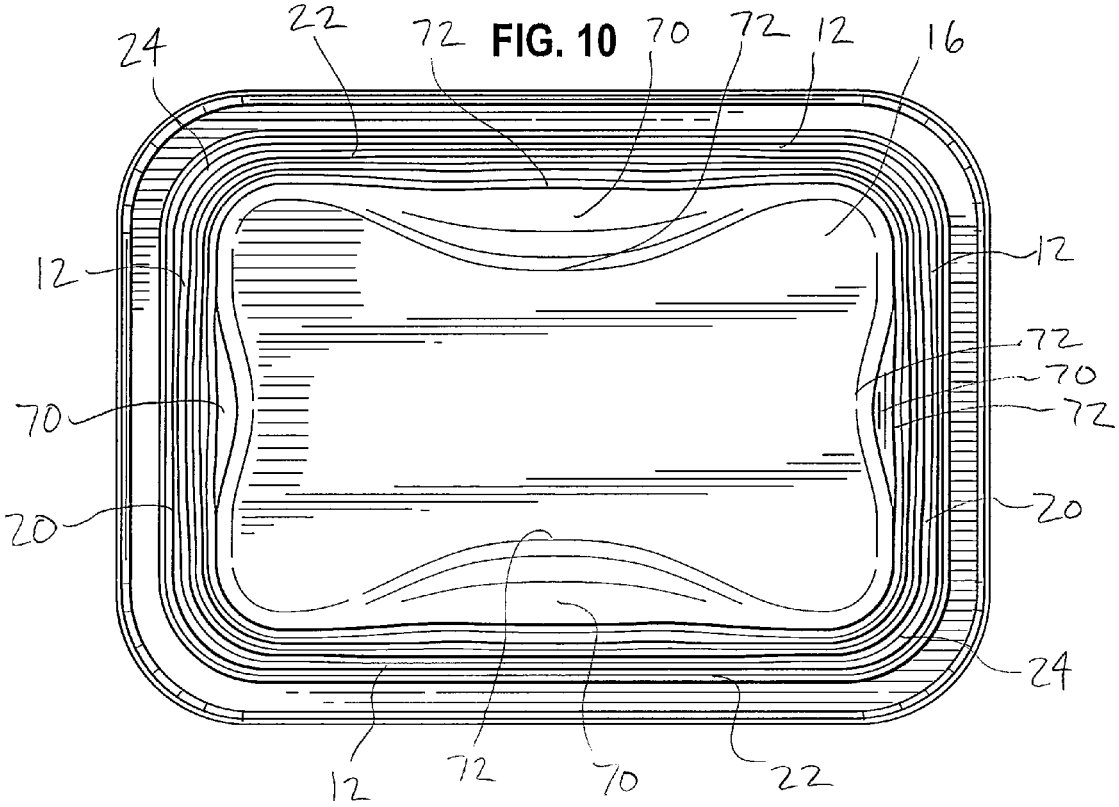
FIG. 10 is a bottom plan view of the tray of FIG. 6 showing the stepped configuration of the bell-shaped ribs of the sidewall and the depressions extending from the bottom wall to the sidewall portions.

The configuration of the ribs 58, 60, 62 on the four rib tray is substantially similar to the three rib tray discussed above. As shown in FIG. 7, the rib side portions 64 have a gradually deepening profile staring with the shallow profile of the upper rip 58 to the relatively deep profile of the bottom rib 62. Due to the number of the ribs, however, the vertices 40 of the ribs 58, 60, 62 are not confined to the upper half of the sidewall side portion 22, instead being positioned in about the top 60 percent of the sidewall side portion 22, and more preferably in the top 55 percent on the sidewall side portions 22, and top 57 percent on the sidewall end portions 20. Similar to the above tray configuration, however, each of the legs 42 are positioned below their respective vertex 40.

For the rib side portions 64, the vertices 40 of upper rib 58 and the first intermediate rib 60 are spaced about 0.38 inches, the vertices 40 of the intermediate ribs 60 are spaced about 0.31 inches, and the vertices 40 of the second intermediate rib 60 and the bottom rib 62 are spaced about 0.31 inches. While the vertices 40 of the rib side portions 64 are positioned in the upper 60 percent of the sidewall end portion 20, the legs 42 thereof are spanned across a majority of the height of the sidewall 14 adjacent to the sidewall corners 24. In the illustrated form, the upper rib 58 has a relatively shallow profile with the legs 42 thereof intersecting the sidewall corners 24 about 0.31 inches below the vertex 40 thereof; the first intermediate rib 60 has a relatively deeper profile with the legs 42 thereof intersecting the sidewall corners 24 about 0.5 inches below the vertex 40 thereof; the second intermediate rib has a relatively deeper with the legs 42 thereof intersecting the sidewall corners 24 about 0.56 inches below the vertex 40 thereof, and the bottom rib 62 has the relatively deepest profile with the legs 42 thereof intersecting the sidewall corners about 0.75 inches below the vertex 40 thereof, or spaced 0.31 inches from the bottom wall portion 16.

For the rib end portions 66, the vertices 40 of upper rib 58 and the first intermediate rib 60 are spaced about 0.38 inches, the vertices 40 of the intermediate ribs 60 are spaced about 0.038 inches, and the vertices 40 of the second intermediate rib 60 and the bottom rib 62 are spaced about 0.44 inches. While the vertices 40 of the rib side portions 64 are positioned in the upper 60 percent of the sidewall end portion 20, the legs 42 thereof are spanned across a majority of the height of the sidewall 14 adjacent to the sidewall corners 24. In the illustrated form, the upper rib 58 has a relatively shallow profile with the legs 42 thereof intersecting the sidewall corners 24 about 0.31 inches below the vertex 40 thereof; the first intermediate rib 60 has a relatively deeper profile with the legs 42 thereof intersecting the sidewall corners 24 about 0.56 inches below the vertex 40 thereof the second intermediate rib has a relatively deeper with the legs 42 thereof intersecting the sidewall corners 24 about 0.63 inches below the vertex 40 thereof, and the bottom rib 62 has the relatively deepest profile with the legs 42 thereof intersecting the sidewall corners about 0.69 inches below the vertex 40 thereof, or spaced 0.31 inches from the bottom wall portion 16.

Turning now to FIGS. 1, 5, 6, and 10, the tray 10 can include one or more depressions 70, which in one aspect can act as gripping portions or contours. For example, the depressions 70 can enable a user of the tray 10 to more easily grip the tray 10 around the sidewall 14 and around the bottom wall 16. In the illustrated form, the depressions 70 span over the corners 28 between the sidewall 14 and the bottom wall 16 intermediate of the sidewall corners 24 onto the bottom wall 16 and sidewall 14. The depressions 70 can be provided on one, two, three, or all four of the sidewall portions 20, 22 as desired. In the illustrated form, the tray includes four depressions 70 that extend from the bottom wall 16 onto the respective side wall portions 20, 22. Preferably, to provide an ergonomic contour, the depressions 70 have a curved profile such that the depressions 70 are recessed the deepest into the bottom wall 16 and the sidewall 14 along a center line C thereof. Moreover, as shown in FIG. 1, the center line C preferably stops prior to curved ends 72 of the depressions 70 so that the ends have tapering walls connecting to adjacent portions of the bottom wall 16 or sidewall 14 respectively.

Figure 11:
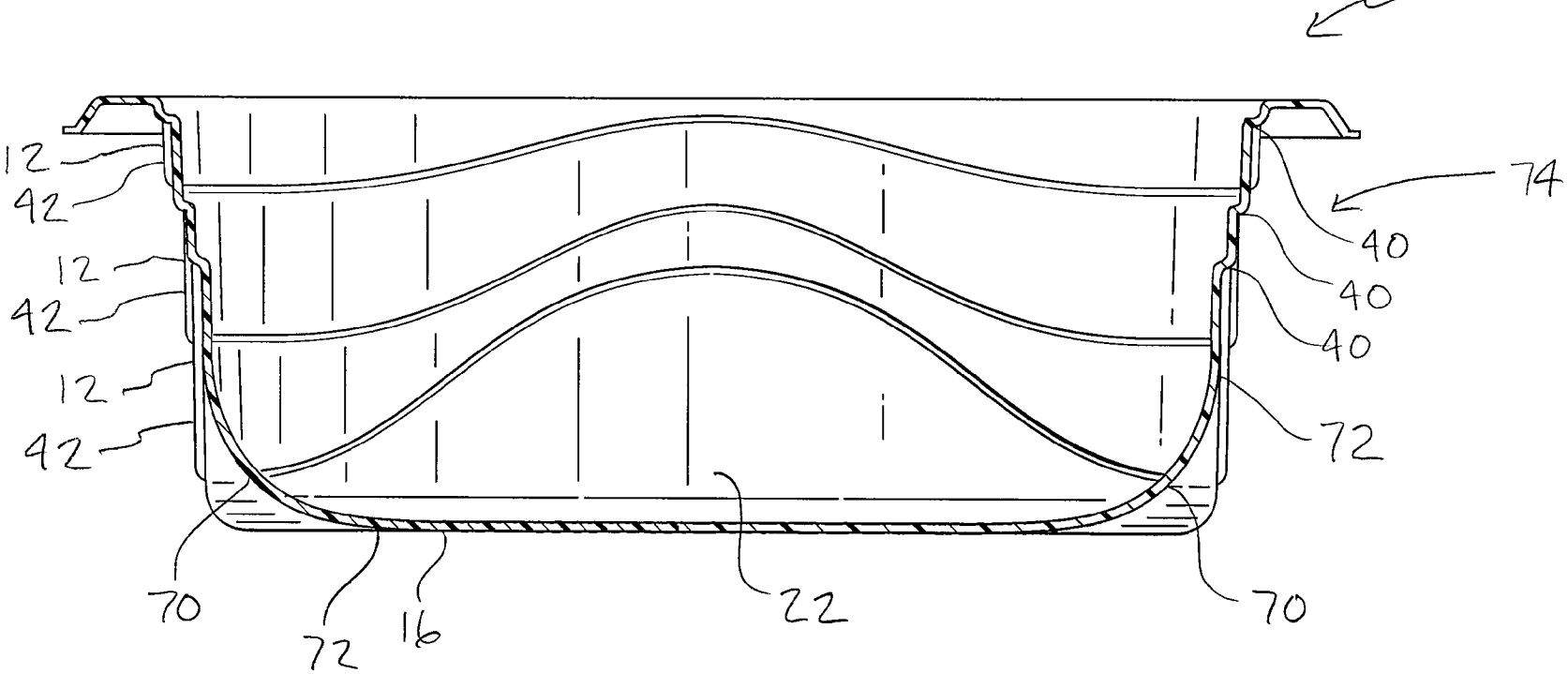
FIG. 11 is a cross-section view of the tray of FIG. 1 taken along the line 11-11 in FIG. 1.

The depressions 70 waist the bottom wall 16 in both directions, giving the bottom wall 16 a bone-shaped configuration. Additionally, as shown in FIG. 11, the depressions 70 in the sidewall portions 20, 22 cause an upper portion 74 of each sidewall portion 20, 22 to be positioned above the footprint, or generally planar portion, of the bottom wall 16 absent the depressions 70. The vertices 40 of the ribs 12 are located within the upper portion 74 to direct vertical compressive forces outwardly about either side of the depression 70 towards the bottom wall 16 and the sidewall corners 24.

Figure 6:
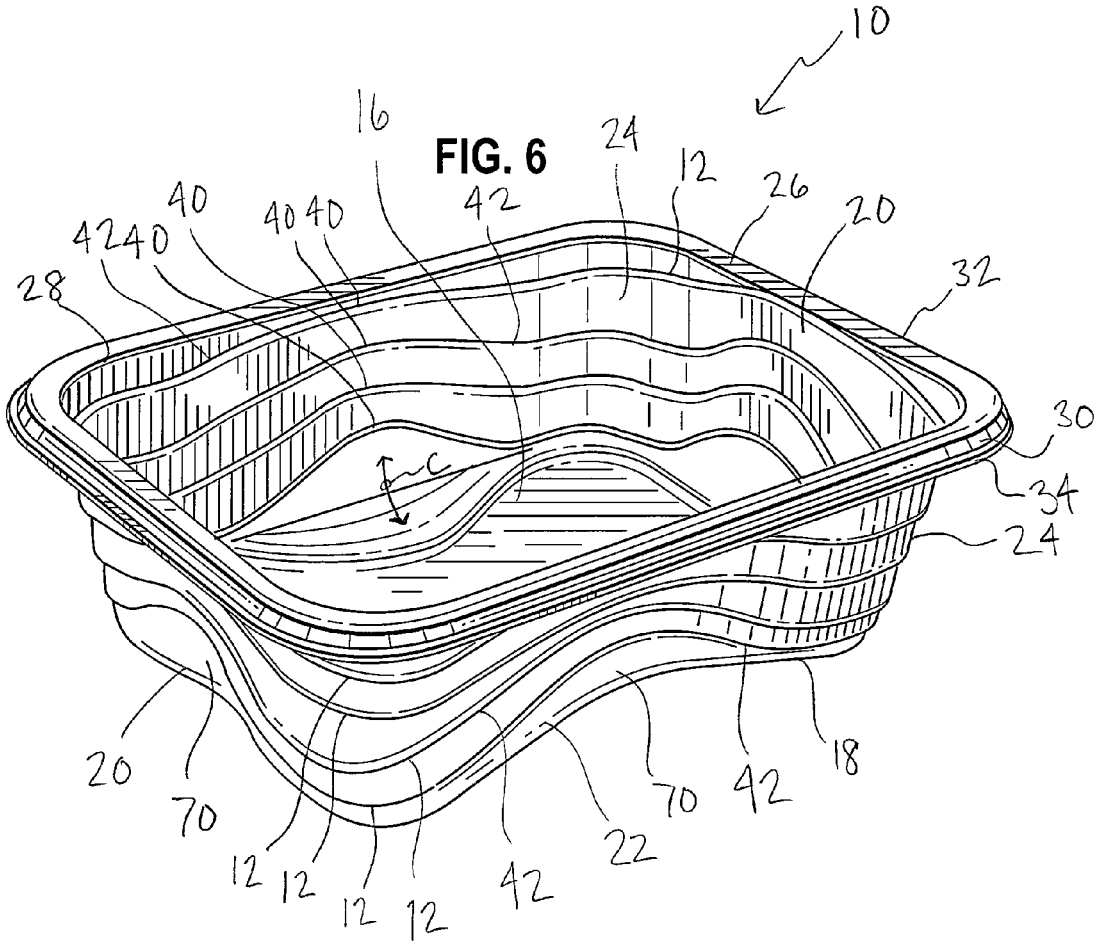
FIG. 6 is a perspective view of a second embodiment of a tray with a bottom wall and an upstanding sidewall having three bell-shaped ribs on sidewall portions thereof and depressions extending from the bottom wall to the sidewall portions.

As best shown in FIGS. 1 and 6, the curvilinear configurations of the ribs 12 advantageously are complementary to the gripping portions 70 extending onto the tray sidewall portions 20, 22. Specifically, the curved ends 72 of the gripping portions 70 extend from the bottom corner 18 across a portion of the sidewall portions 20, 22. Vertical ribs would disadvantageously intersect this gripping portion and would therefore not extend along the full height of the sidewall 14. On the other hand, the curvilinear ribs 48, 50, 52 described herein include vertices 40 positioned above the respective gripping portion 70 and legs 42 that extend downwardly along the curved ends 72 of the gripping portion 70.

In the illustrated form, the upper end 28 of the side wall 14 has a rectangular configuration with the corners 24 thereof rounded. The rectangular configuration provides a consumer with full access to the various corners 24 of the sidewall 14, the corners 18 of the bottom wall 16, and the intersections therebetween. If desired, the gripping portions 70 could extend all the way through the sidewall 14 to the upper end 28 thereof. As such, the sidewall 14 would be an upstanding wall having the bone-shaped configuration of the bottom wall 16. Such a sidewall 14, however, would undesirably restrict access to the corners of the tray 10, such as with a utensil or the like.

The shoulder 26 and/or skirt 30 are preferably configured to releasably couple to a lid (not shown) and or have a film (not shown) attached thereto to store and/or seal contents within the tray. For example, a food product can be placed in the tray, a film can be sealed to the shoulder thereof to seal the food product within the tray, and then a lid can be snap-fit or otherwise releasably coupled to the tray. So configured, the tray can be stored, transported, and displayed for sale.

EXAMPLES

Figure 12:
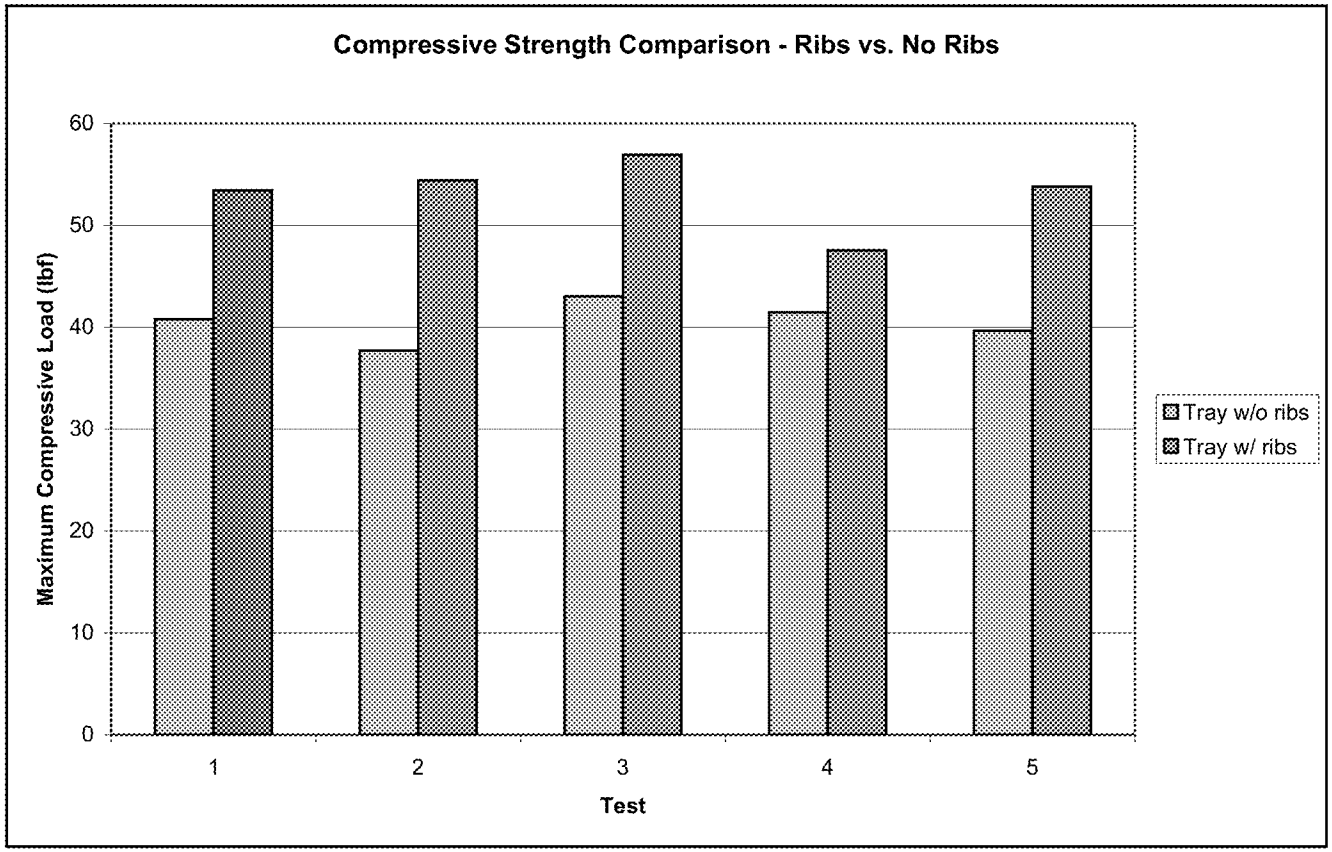
FIG. 12 is a graph showing a compressive strength comparison between a tray with ribs configured as shown in FIGS. 1-5 and a tray without ribs.

To test the compressive load benefit provided by the ribs described herein, a maximum compressive load test was conducted on five (5) trays having the three rib configuration as shown in FIGS. 1-5 and described with reference thereto and, for comparison, on five (5) trays having a configuration substantially similar to the three rib tray without any ribs. The results of the tests are set forth in the below table and in FIG. 12.

| No Ribs | | Ribs | |
|---|---|---|---|
| Test | Max Compressive Load (lbf) | Test | Max Compressive Load (lbf) |
| 1 | 40.79837 | 1 | 53.45000 |
| 2 | 37.71224 | 2 | 54.42493 |
| 3 | 43.03995 | 3 | 56.93102 |
| 4 | 41.47299 | 4 | 47.55648 |
| 5 | 39.66409 | 5 | 53.80735 |

To conduct the tests, a preload compressive load was placed on each tray of between 5 and 12 lbf. The machine was then allowed to increase the compressive load on each tray until the maximum compressive load was determined. As shown, for every test, the curvilinear ribs described herein caused the tray to have an increased maximum compressive load over a similar tray without ribs. The trays without ribs had an average maximum compressive load of about 40.5 lbf while the trays with ribs had an average maximum compressive load of about 53.2 lbf. Therefore, the ribs described herein provided an approximately 31% increase in compressive strength from a tray without ribs.

The drawings and the foregoing descriptions are not intended to represent the only forms of the package in regards to the details of construction. Changes in form and in proportion of parts, as well as the substitution of equivalents, are contemplated as circumstances may suggest or render expedient.

The invention claimed is:

1. A thin walled tray for a foodstuff strengthened for supporting compressive loads when stacked, the tray comprising:

a bottom wall having four corners;

a sidewall extending about and upstanding from the bottom wall, the sidewall having an upper periphery, four corners and sidewall segments extending between adjacent pairs of the corners, each of the sidewall segments having at least one continuous, protruding rib configured to redirect vertical compressive forces from an intermediate portion of the sidewall segment to the adjacent corners, the rib having a vertex portion in the intermediate portion of the sidewall and inclined portions extending therefrom at a downward inclination toward the bottom wall and the respective adjacent corner; and depressions in opposing sidewall segments creating inwardly curved recessed portions of the opposing sidewall segments with respect to adjacent portions thereof that extend from the sidewall segments to the bottom wall so that the bottom wall has a waisted configuration wherein the smallest width of the bottom wall at the waisted configuration between the two opposite depressions is less than the width of the bottom wall between adjacent portions thereof, the depressions being located within the intermediate portion of the sidewall and generally aligned with the vertex portion of the rib so that the vertex portion of the rib is aligned over and overhangs the recessed portions of the opposing sidewall segments.

2. The tray of claim 1, wherein the depressions have a curved end on the opposing sidewall segments, the corresponding rib has a bell-shaped configuration, and the curved end of the depression on the sidewall segment is at least partially complementary to the bell-shaped configuration of the corresponding rib.

3. The tray of claim 1, wherein the inclined portions of the rib are curvilinear.

4. The tray of claim 3, wherein the vertex portion is closer to the upper periphery of the sidewall than the bottom wall.

5. The tray of claim 4, wherein the rib extends substantially parallel to the bottom wall adjacent each of the corners to redirect vertical compressing forces along the inclined portions of the rib.

6. The tray of claim 1, wherein the rib of each of the sidewall segments intersects adjacent ribs of adjacent sidewall segments to offset compressive forces from the adjacent ribs.

7. The tray of claim 1, wherein a plurality of the ribs are provided on each sidewall segment.

8. The tray of claim 7, wherein each of the ribs on each of the sidewall segments are closer spaced at a midpoint of each sidewall segment as compared to adjacent corners.

9. The tray of claim 1, wherein the rib has a bell-shaped configuration.

10. The tray of claim 9, wherein a plurality of ribs are provided on each sidewall segment, and each of the ribs has the bell-shaped configuration.

11. The tray of claim 8, wherein the vertex portions of the plurality of ribs are positioned within an upper sixty percent of the respective sidewall segment.

12. The tray of claim 1, wherein the depressions are in all four sidewall segments so that the bottom wall has a waisted configuration in two directions.

13. The tray of claim 1, wherein lateral portions of the opposing sidewall segments above the rib thereof are generally planar and lateral portions of the opposing sidewall segments including the depressions are generally curvilinear.

14. A thin walled tray for a foodstuff strengthened for supporting compressive loads when stacked, the tray comprising:

a bottom wall portion having side edges and end edges;

a sidewall portion upstanding from the side and end edges of the bottom wall portions so that the sidewall includes side and end wall portions connected at sidewall corners with a continuous upper periphery, each of the side and end wall portions including at least one protruding rib extending thereacross, the rib having a bell-shaped configuration with a generally centrally located upper vertex and legs extending downwardly therefrom to intersect adjacent sidewall corners at a height of the sidewall lower than the upper vertex; and depressions in the side wall portions creating inwardly curved recessed portions of the side wall portions with respect to adjacent portions thereof that extend from the side wall portions to the bottom wall portion so that the bottom wall portion has a waisted configuration wherein the smallest width of the bottom wall at the waisted configuration between the two opposite depressions is less than the width of the bottom wall between adjacent portions thereof, the depressions being generally aligned with the generally centrally located upper vertex of the rib so that the upper vertex portion of the rib is aligned over and overhangs the recessed portions of the side wall portions.

15. The tray of claim 14, wherein each of the side and end wall portions include three or more of the outwardly protruding ribs in a stacked configuration extending thereacross, each of the ribs having the bell-shaped configuration.

16. The tray of claim 15, wherein the vertices of the ribs are located in the upper sixty percent of each of the sidewall side and end wall portions.

17. The tray of claim 15, wherein a distance between the vertex and the height that the legs intersect the adjacent sidewall corners of each rib decreases with rib proximity to the upper periphery of the sidewall portion.

18. The tray of claim 14, wherein the rib continuously extends around the sidewall portion.

19. The tray of claim 14, further comprising depressions in the end wall portions creating recessed portions of the end wall portions with respect to adjacent portions thereof and extending from the end wall portions onto the bottom wall portion so that the bottom wall portion has a waisted configuration in two directions, the depressions being generally aligned with the generally centrally located upper vertex of the rib so that the upper vertex portion of the rib is aligned over the recessed portions of the end wall portions.

20. The tray of claim 14, wherein the depressions have a curved end on each side wall portion that is at least partially complementary to the bell-shaped configuration of the corresponding rib.

* * * * *